US005727526A

United States Patent [19]

Kratt et al.

[11] Patent Number: 5,727,526

[45] Date of Patent: Mar. 17, 1998

[54] DEVICE AND METHOD FOR DETERMINING A LOAD SIGNAL IN AN INTERNAL COMBUSTION ENGINE

[75] Inventors: Alfred Kratt; Claus-Dieter Nusser, both of Schwieberdingen; Markus Lischwe, Rieden, all of Germany

[73] Assignee: Robert Bosch GmbH, Stuttgart, Germany

[21] Appl. No.: 628,121

[22] Filed: Apr. 4, 1996

[30] Foreign Application Priority Data

Apr. 13, 1995 [DE] Germany ..... 195 13 975.5

[51] Int. Cl.[6] ..... F02M 51/00

[52] U.S. Cl. ..... 123/480

[58] Field of Search ..... 123/480, 486, 123/425, 350; 364/431.05

[56] References Cited

U.S. PATENT DOCUMENTS 4,275,695 6/1981 Bauer et al. ..... 123/480
5,282,449 2/1994 Takahashi et al. ..... 123/350
5,284,116 2/1994 Richeson et al. ..... 123/425
5,293,553 3/1994 Dudek et al. ..... 364/431.04
5,367,462 11/1994 Klenk et al. ..... 364/431.05

FOREIGN PATENT DOCUMENTS 28 40 793 4/1980 Germany ..... 123/480

*Primary Examiner*—Raymond A. Nelli
*Attorney, Agent, or Firm*—Kenyon & Kenyon

[57] ABSTRACT

A device for determining a load signal indicating the actual air mass per stroke in an internal combustion engine based on signals which indicate the respective instantaneous air flow rate in the intake pipe, these signals being indirectly or directly summed up over a specified angular range of the crankshaft for forming the load signal. In first predetermined ranges of speeds and throttle-valve positions, the load signal serves directly as a computational basis for the quantity of fuel to be injected. In second predetermined ranges, the last value from the first ranges is subjected to a speed-dependent correction and this corrected value is used as a substitute load signal.

12 Claims, 3 Drawing Sheets

DEVICE AND METHOD FOR DETERMINING A LOAD SIGNAL IN AN INTERNAL COMBUSTION ENGINE

FIELD OF THE INVENTION

The present invention relates to a device and a method for determining a load signal in an internal combustion engine.

BACKGROUND INFORMATION

German Patent Application No. DE 28 40 793 describes a method for determining the air mass taken in by an internal combustion engine by means of a sensor which measures the air mass flow and whose output signal is sampled at certain times or certain angular positions. The sampled values are summed up over a specified angular range for determining the air mass per stroke and this summed value is subsequently corrected using a characteristic map. As part of this correction, pulsations in the intake pipe can be taken into account for certain combinations of the operating parameters speed and load.

An object of the present invention is to create a corresponding device and method, each of which is adapted in the simplest possible manner to the special requirements of internal combustion engines.

SUMMARY OF THE INVENTION

This objective is solved by a device and a method for determining a load signal in an internal combustion engine having an intake pipe and a crankshaft, where the load signal is used to determine a quantity of fuel to be injected into the internal combustion engine. A sensor is included according to the present invention for measuring an air mass flow and for providing a signal at predetermined periods indicating an instantaneous air flow rate in the intake pipe. The signals are summed over a predetermined angular range of the crankshaft to form the load signal when the internal combustion engine operates in a first predetermined range of speeds and in a first predetermined range of throttle valve positions. A processor is also included according to the present invention for coupling to the sensor and for generating a substitute load signal to be used in place of the load signal when the internal combustion engine operates in a second predetermined range of speeds and in a second predetermined range of throttle valve positions. The substitute load signal is generated by the processor as a function of a last value of the load signal and a speed dependent correction value.

DETAILED DESCRIPTION

In all engines, there are speed/load regions in which pulsations or return flows occur in the induction pipe. If a sensor 20 (shown in FIG. 5), e.g., a hot-film air-mass meter (HFM) is used to measure the air flow rate, then, depending on the design of the HFM, the processing of its output signal can yield an incorrect load signal in these regions; which leads to a leaning or an over-enrichening of the mixture. This error in measuring the load can be very large so that the engine can no longer be operated optimally. The occurrence and the magnitude of the pulsations and return flows are dependent on the position of the throttle valve and generally occur in a throttle-valve region in which the maximum induction pipe filling is already present.

Figure 1:
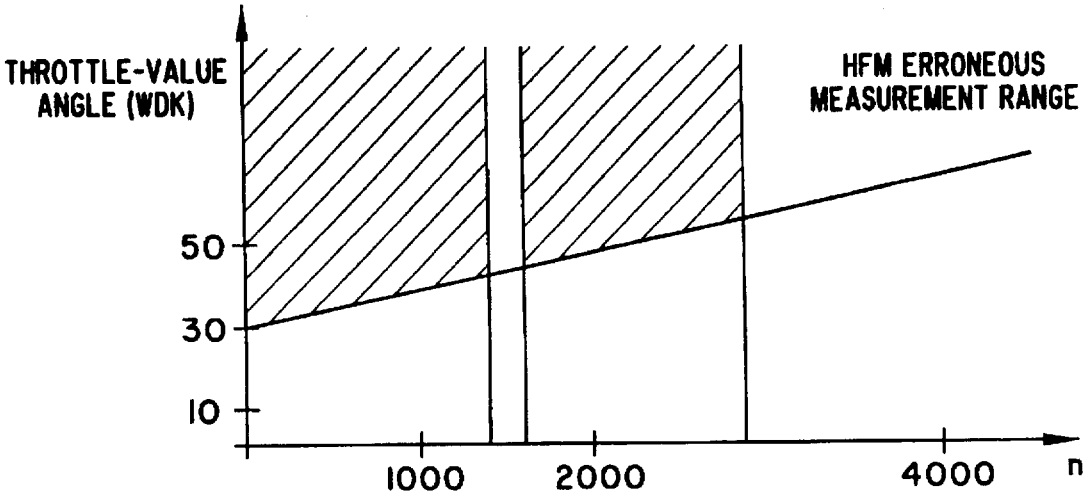
FIG. 1 shows a graph of the throttle-valve angle plotted as a function of speed for illustrating possible erroneous measurements.

FIG. 1 shows regions in the speed/throttle-valve angle WDK vs. speed n graph in which erroneous measurements are possible due to pulsations. FIG. 1 illustrates that these possible erroneous measurements occur starting with medium openings of the throttle valve and in special speed regions. This is due to the physical pneumatic conditions then prevailing in the air intake pipe.

Figure 2:
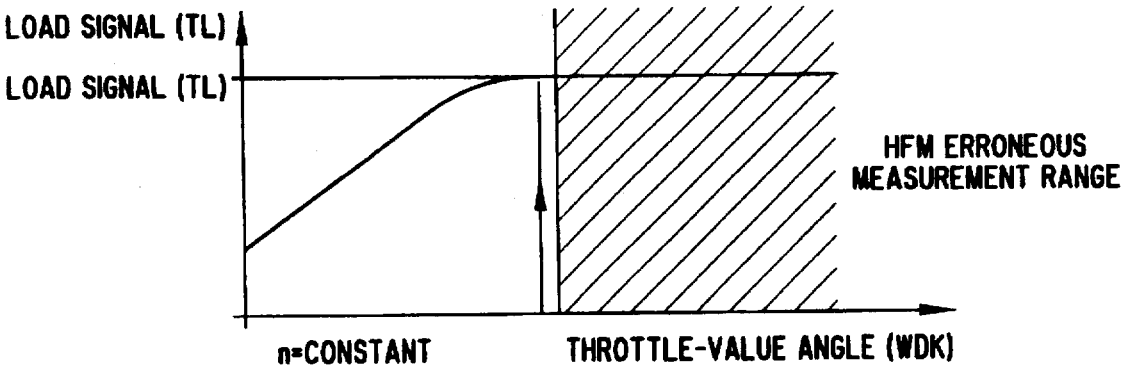
FIG. 2 shows a graph of the load signal TL plotted as a function of throttle-valve angle for illustrating additional erroneous measurements that may occur.

The graph in FIG. 2 shows that the load signal TL increases for constant speed in the region of lower throttle-valve opening angles, but does not increase further for larger opening angles, or increases the load signal TL only slightly. Therefore, according to the present invention, before the shaded region of high throttle-valve opening angles is reached with the possibility of erroneous measurements, the load signal is frozen and further computations are made with a substitute load signal.

Figure 3:
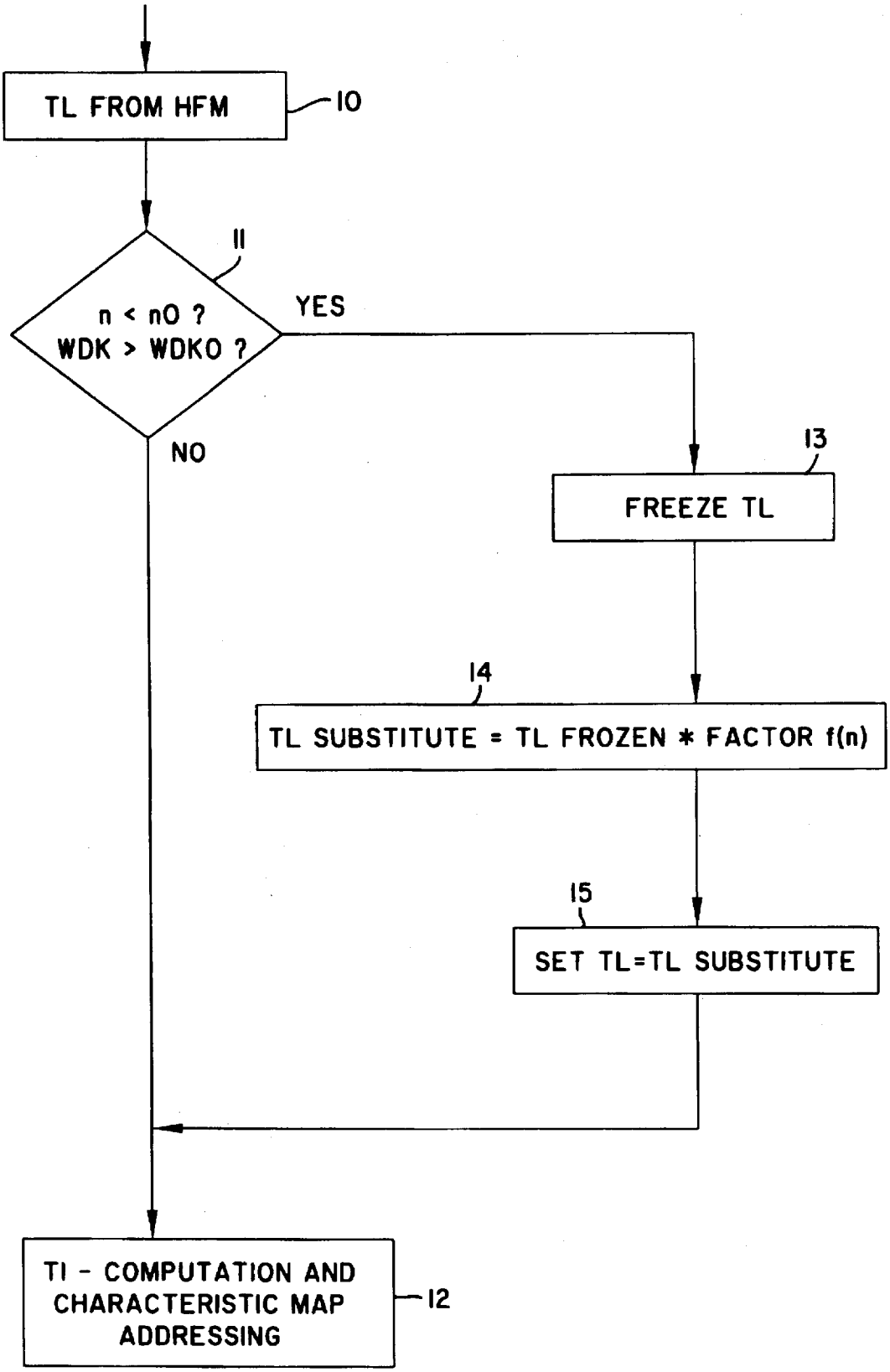
FIG. 3 shows a flow chart of the operation of the device and method according to an embodiment of the present invention.

FIG. 3 shows a section of a flow chart in the formation of the load signal in the context of the determination of the amount of fuel to be injected in an internal combustion engine. In block 10, the determination of the load signal TL from measurement signals of the sensor 20 (shown in FIG. 5) or of the hot-film air-mass meter (HFM) is shown. This is followed by a query 11 as to whether the speed n lies below a threshold n0 and the throttle-valve opening angle WDK lies above a corresponding threshold WDK0. If the result of the query is "NO", then the block 12 follows in which the quantity of fuel to be injected TI is determined using, for example, a processor 21 (shown in FIG. 5). If, on the other hand, the result of the threshold query was "YES", then this marks the end of the region without risk of an erroneous measurement and the load signal TL from block 10 is frozen, i.e., stored, in accordance with block 13. Afterwards, a substitute load signal is formed in block 14 based on the formula:

$$TLSubstitute=TLFrozen*Factor\ f(n).$$

Figure 5:
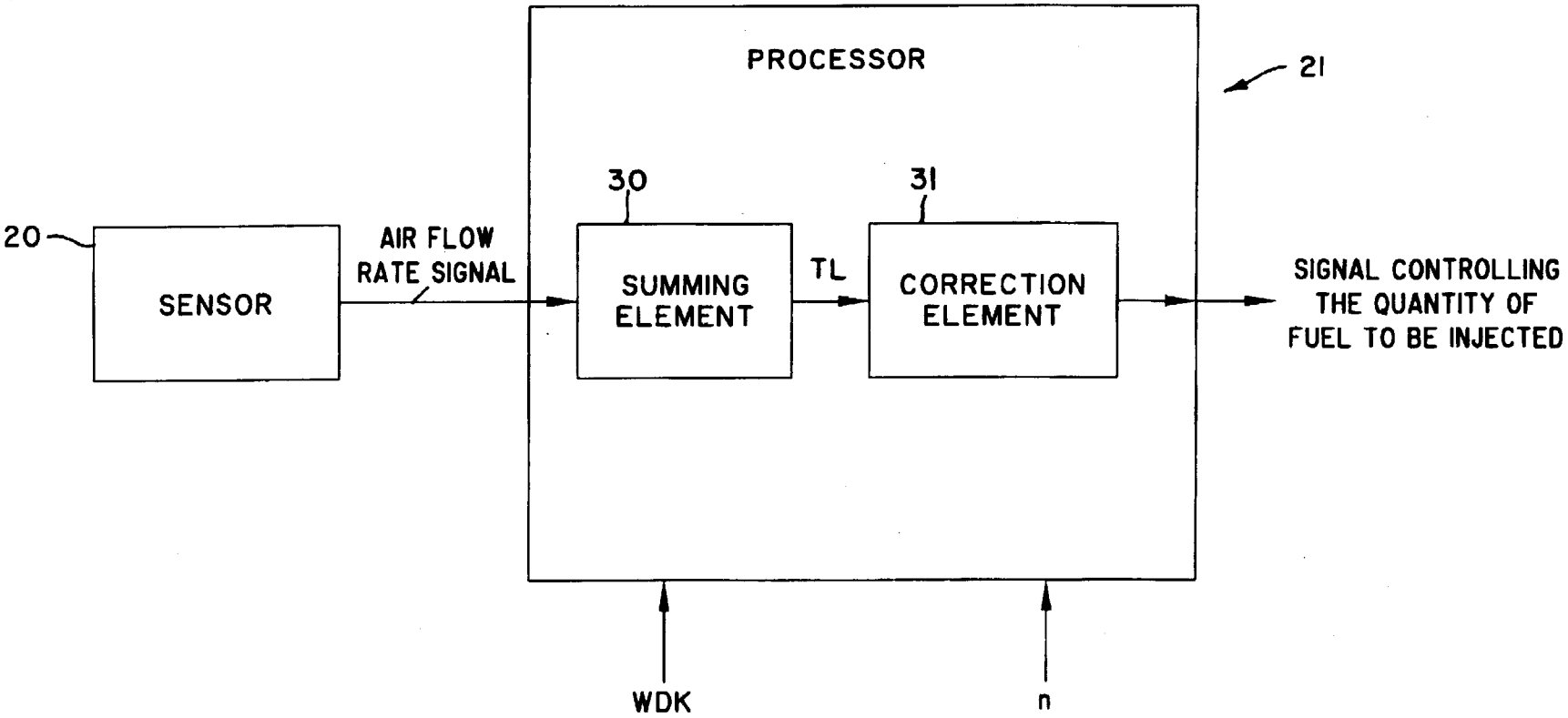
FIG. 5 is a block diagram of an exemplary embodiment of a device according to the present invention.

The substitute load signal is then set (block 15) and serves as an input variable for the subsequent block 12 for determining the quantity to be injected using, for example, processor 21 (shown in FIG. 5). The operational flow chart in FIG. 3 illustrates that as long as the HFM is providing a result which is not yet invalid, the computation is made with a load signal TL determined on the basis of the HFM values. However, if there is a risk of erroneous measurements, then the last "correct" value is frozen, provided with a speed-dependent correction factor and used in the further computational steps as a substitute load signal.

Figure 4:
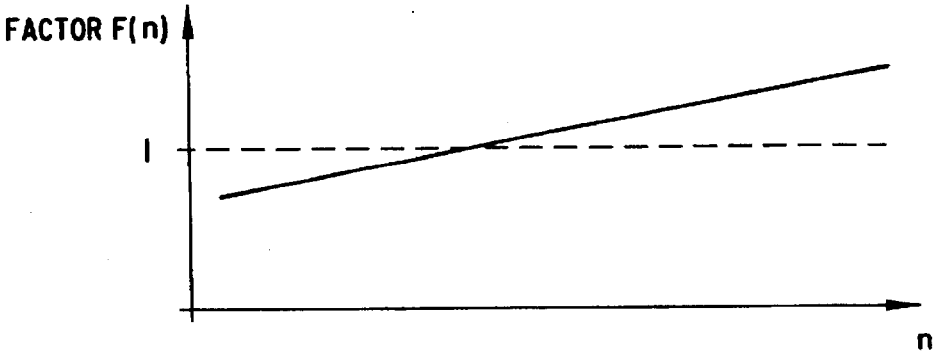
FIG. 4 shows a graph of the correction factor plotted as a function of speed.

FIG. 4 shows an example for a correction factor which is dependent on the speed, as can be used in block 14 of the flow chart in FIG. 3. In such case, there is a recognizable tendency to use the range from less than 1 to greater than 1 as the speed increases. Therefore, it would be beneficial to adapt this characteristic curve for the factor to the particular engine in question. The following values were determined, for example, to be suitable:

| n | 600 | 800 | 1200 | 1600 | 2000 | 2400 |
|---|---|---|---|---|---|---|
| WDKBL | 30 | 40 | 40 | 40 | 42 | 45 |
| Factor f(n) | 0.95 | 1.0 | 1.02 | 1.05 | 1.1 | 1.15 |

This factor f(n) represents the variation in the substitute load value with changing speed. Upon reaching the throttle-valve position which is plotted in the graph of FIG. 2, the factor of the instantaneous speed is stored. For increasing or rather decreasing speed, the factor associated with the speed is taken in each case from the characteristic curve and the stored value is subtracted from this value. To this result, one (1) is added and multiplied by the stored TL value, thus yielding the substitute load value, which substitutes the current load value in block 15.

If the speed leaves applicable speed/load regions in which HFM measurement errors occur, this function is switched back off. To be independent of magnitude, correction can be made under certain circumstances over the throttle-valve angle. In addition, the "freezing" of TL is advantageous in that the correct air mass (TL) is used as long as possible.

FIG. 5 shows the device according to the present invention. The device includes a sensor 20 (e.g., a hot-film air-mass meter) which measures the air flow rate and generates air flow rate signals. Sensor 20 provides the air flow rate signals to processor 21, which includes a summing element 30 and a correction element 31. Summing element 30 sums up the signals at the predetermined periods over a predetermined angular range of the crankshaft to form the load signal TL when the internal combustion engine operates in a first predetermined range of speeds and in a first predetermined range of throttle-valve positions. Correction element 31 receives the load signal TL. After receiving the load signal TL from the summing element 30, correction element 31 performs the process illustrated in the flowchart of FIG. 3. Accordingly, processor 21 controls the quantity of fuel injected into the internal combustion engine as a function of at least one of the load signal TL and the substitute load signal.

What is claimed is:

1. A device for determining a load signal in an internal combustion engine having an intake pipe and a crankshaft, the load signal being used to determine a quantity of fuel to be injected into the internal combustion engine, the device comprising:

a sensor measuring an air mass flow, the sensor providing a signal at each of a plurality of predetermined periods, each signal indicating an instantaneous air flow rate in the intake pipe; and a processor coupled to the sensor, wherein the processor sums the signals at the predetermined periods over a predetermined angular range of the crankshaft to form the load signal when the internal combustion engine operates in a first predetermined range of speeds and in a first predetermined range of throttle-valve positions, wherein the processor generates a substitute load signal to be used in place of the load signal when the internal combustion engine operates in a second predetermined range of speeds and in a second predetermined range of throttle-valve positions, the substitute load signal being generated as a function of a last value of the load signal and a speed-dependent correction value, and wherein the processor controls the quantity of fuel injected into the internal combustion engine as a function of at least one of the load signal and the substitute load signal.

2. The device as recited in claim 1, wherein the sensor includes a hot-film air-mass meter.

3. The device as recited in claim 1, wherein the signals are summed indirectly over the predetermined angular range of the crankshaft.

4. The device as recited in claim 1, wherein the signals are summed directly over the predetermined angular range of the crankshaft.

5. The device as recited in claim 1, wherein the substitute load signal is generated via a multiplicative application of the speed-dependent correction value.

6. The device as recited in claim 5, wherein the speed-dependent correction valve increases with increasing speed.

7. A method for determining a load signal in an internal combustion engine having an intake pipe and a crankshaft, the load signal being used to determine a quantity of fuel to be injected into the internal combustion engine, the method comprising the steps of:

generating a signal at each of a plurality of predetermined periods, each signal indicating an instantaneous air flow rate in the intake pipe;

summing the signals of the predetermined periods over a predetermined angular range of the crankshaft to form the load signal when the internal combustion engine operates in a first predetermined range of speeds and in a first predetermined range of throttle-valve positions;

storing, when the internal combustion engine operates in a second predetermined range of speeds and in a second predetermined range of throttle-valve positions, a last value of the load signal;

generating a substitute load signal as a function of the last value of the load signal and a speed-dependent correction value;

replacing the load signal with the substitute load signal; and controlling the quantity of fuel injected into the internal combustion engine as a function of at least one of the load signal and the substitute load signal.

8. The method as recited in claim 7, wherein the step of generating the signal includes the step of generating the signal via a hot-film air-mass meter.

9. The method as recited in claim 7, wherein the step of summing the signals includes the step of summing the signals indirectly over the predetermined angular range of the crankshaft.

10. The method as recited in claim 7, wherein the step of summing the signals includes the step of summing the signals directly over the predetermined angular range of the crankshaft.

11. The method as recited in claim 7, wherein the step of generating the substitute load signal includes a multiplicative application of the speed-dependent correction value.

12. The method as recited in claim 11, wherein the speed-dependent correction value increases with increasing speed.

* * * * *